US005584077A

United States Patent [19]

Thrift

[11] Patent Number: 5,584,077

[45] Date of Patent: Dec. 17, 1996

[54] WEARING APPAREL WITH TRANSFORMATIONAL ABILITIES

[76] Inventor: David M. Thrift, 1124 Brook View, Doraville, Ga. 30340

[21] Appl. No.: 561,917

[22] Filed: Nov. 22, 1995

[51] Int. Cl.[6] ..... A41B 11/00; A41H 43/00

[52] U.S. Cl. ..... 2/239; 223/37

[58] Field of Search ..... 2/239; D2/986, D2/981, 983; 223/37, 38

[56] References Cited

U.S. PATENT DOCUMENTS

| | | | |
|---|---|---|---|
| D. 182,251 | 3/1958 | Rock | D2/981 |
| D. 345,854 | 4/1994 | Fritz | D2/980 |
| D. 348,556 | 7/1994 | Haber . | |
| D. 353,938 | 1/1995 | Lucas, Jr. . | |
| 2,849,167 | 8/1958 | Walser, Jr. | 223/37 |
| 2,959,946 | 11/1960 | Levin | D2/980 |
| 3,017,640 | 1/1962 | Cardwell et al. . | |
| 3,023,420 | 3/1962 | Tann . | |
| 3,039,282 | 6/1962 | Hayes . | |
| 3,902,300 | 9/1975 | Glaze, Jr. | 223/37 |
| 4,005,494 | 2/1977 | Burn . | |
| 4,038,699 | 8/1977 | Burn . | |
| 4,295,647 | 10/1981 | Daly . | |
| 4,404,689 | 9/1983 | DeWan | 2/247 |
| 5,090,938 | 2/1992 | Reynolds . | |
| 5,325,545 | 7/1994 | Hirano . | |
| 5,417,091 | 5/1995 | Moser | 2/239 |

*Primary Examiner*—Bibhu Mohanty
*Attorney, Agent, or Firm*—Hinkle & Associates, P.C.

[57] ABSTRACT

A method for transforming a pair of socks (11, 12) into a three dimensional recognizable object, and a pair of socks capable of transforming into a three dimensional recognizable object. The pair of socks having a design (13) made on an inside surface (14) of one of the socks (12) whereby the pair of socks (11, 12) forms a three dimensional recognizable object when the individual socks are rolled up together.

5 Claims, 2 Drawing Sheets

11
12
13
14
15
16
17
18
19
20
21
22
23
24
25
26
27
28
29
30
31
32
33

WEARING APPAREL WITH TRANSFORMATIONAL ABILITIES

BACKGROUND OF THE INVENTION

I. Field of the Invention

The present invention relates generally to a pair of socks, and in particular to a pair of socks which have the capability of transforming into a three dimensional recognizable object.

II. Description of the Related Art

It is known in the prior art to add decorative features to ordinary socks in order to make them more attractive to children and others. For example U.S. Pat. No. 5,325,545 issued to Hirano discloses a pair of bags positioned on the front of an ordinary pair of socks. The bags can be filled to form round shapes like ears, and an animal face can be illustrated on the front of the sock to provide a three dimensional shape. Another example of this type of sock is U.S. Pat. No. 3,023,420 issued to Tann. In the '420 Patent a three dimensional puppet is attached to the end of the socks. It is also well known to print patterns and shapes on the outside of socks to provide aesthetically pleasing designs.

The present invention provides the ornamental and decorative features of the above described inventions but does not share the drawbacks of those inventions. The above described socks are of limited use as the attachments to the sock provide a snag point that can get caught on objects that are low to the ground. Also, the socks described above would not be suitable for athletic or dress socks. This invention provides a source of motivation for children and adults alike to pair and store their socks in a fun way. It also provides an educational hand to eye coordination exercise for children. The present invention combines the fun and ornamental elements of the prior art by transforming a pair of socks into a decorative object. The present invention does not have the same limitations as the socks described above because, when in use, the socks of the present invention are indistinguishable from ordinary socks of any kind including dress and athletic socks. The socks are transformed into a decorative object only when they are stored prior being worn.

It has been common in the past to roll up a pair of socks by the method utilized in the present invention. However, the practice of making a three dimensional graphic design on the inside surface of one of the socks in order to form a recognizable likeness of a three dimensional object when the socks are rolled up has heretofore not been known.

SUMMARY OF THE INVENTION

The present invention comprises a pair of socks (or in some instances just one sock) in which at least one of the socks contains a graphic design placed on the inside surface such that when two socks are rolled up together, the resulting object is roundish and decorated with the pattern that was made on the inside surface of one of the socks. The present invention further comprises a method for turning an ordinary pair of socks into a recognizable, three dimensional object by placing a three dimensional graphic design on the inside surface of one of the socks, placing the other sock on top of the sock containing the graphic design, rolling the socks upward from the toes of the socks toward the tops of the socks such that the sock containing the three dimensional graphic design is positioned on the outside of the roll, holding an inside edge of the graphically enhanced sock against the resulting roll, and pulling the other inside edge of the sock containing the three dimensional graphic design in the opposite direction over the resulting roll until it meets with the inside edge that is being held.

An object of the present invention is to create a recognizable three dimensional object frown an ordinary pair of socks.

Another object of the present invention is to create a pair of socks which can be transformed into a recognizable object when in storage and which is indistinguishable from an ordinary pair of socks when the pair is being worn.

Other objects, advantages and capabilities of the invention will become apparent from the following description taken in conjunction with the accompanying drawings showing preferred embodiments of the invention.

DESCRIPTION OF THE PREFERRED EMBODIMENTS

Figures 1, 2, 3, 4, 5, 6, 7:
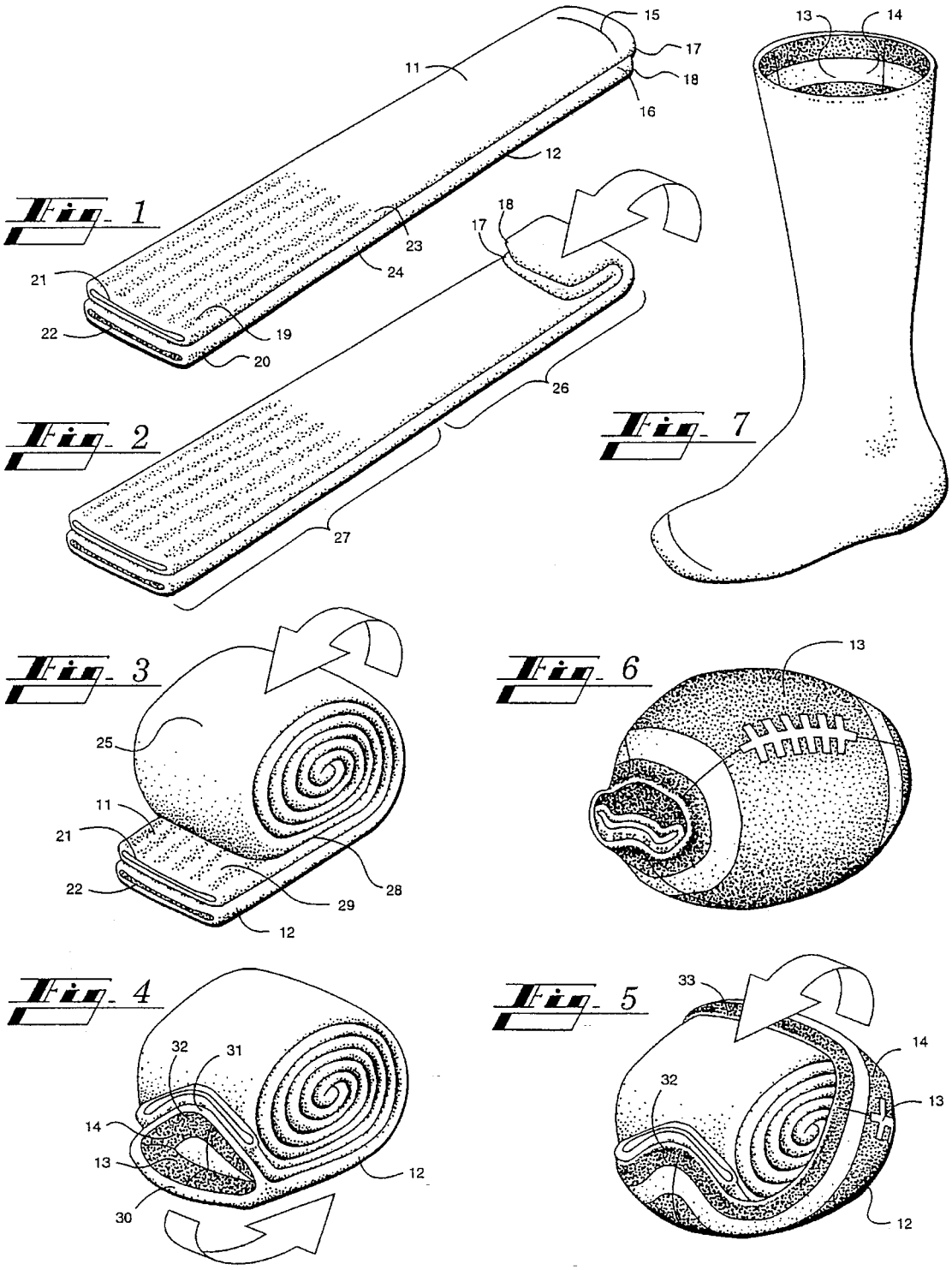
FIG. 1 is a perspective view of a pair of socks lying flat with one sock lying on top of the other sock.
FIG. 2 is a perspective view of a pair of socks, one sock lying on top of the other with the toes of the sock being tucked and ready to roll.
FIG. 3 is a perspective view of the pair of socks being rolled up together.
FIG. 4 is a perspective view of a pair of rolled socks showing the bottom sock top being opened, ready to be pulled inside out and over the sock roll.
FIG. 5 is a perspective view of the bottom sock being pulled inside out and over the rolled up socks to form a recognizable roundish object.
FIG. 6 is a perspective view of the resulting recognizable three dimensional object which forms the shape and design of a football.
FIG. 7 is a perspective view of a single sock illustrating how the three dimensional graphic design is located on the inside upper portion of the sock.

Referring to the drawings wherein like reference numerals designate corresponding parts throughout the several figures, and initially referring to FIG. 1, the method of the present invention begins with a first sock 11 of ordinary construction lying on told of a second sock 12 that is ordinary except for a predetermined three dimensional graphic design 13 made on an inside surface 14 of the sock (best shown in FIG. 7). The three dimensional graphic design can be put on the inside surface of the sock by the use of a silk-screen, an airbrush, a heat transfer or any other graphic arts method. Also, the design could be stitched, woven, or knitted into the construction of the sock. The socks are tubular in shape with closed ends 15 and 16 having toes 17 and 18 and opposite open ends 19 and 20 which have open tops 21 and 22. The tops of socks usually have elastic sewn into them to keep the socks from falling down. The socks in FIG. 1 are stacked with toe 17, toe 18, side 23, and side 24 being generally aligned.

In FIG. 2 sock toe 17 and toe 18 have been tucked on the lower portion of the pair of socks ready to be rolled.

As shown in FIG. 3, the socks are rolled up with the second sock 12 positioned on the outside of the first sock 11. Starting at the toes 17 and 18, the socks are rolled up until a sock roll 25 is formed. The sock roll 25 is formed by rolling the toes forward against a lower portion 26 of the sock. Next, the sock roll 25 is rolled forward toward an upper portion 27 of the socks. The sock roll 25 is rolled toward the upper portion 27 of the socks until it almost reaches the open top 21 and the open top 22 of the socks. As shown in FIG. 3, an outside surface 28 of the second sock 12 is nested on top of an outside surface 29 of the first sock 11. The lower portion 26 and the upper portion 27 define a middle area therebetween.

In FIGS. 4 and 5, the open top 22 of sock 12 is opened up and pulled over the sock roll 25. A first side 30 of the top of sock 12 is stretched over the roll 25 until it meets a second side 31 of the top of the sock 12. In order to pull the second sock 12 over the sock roll, an edge 32 of the open top 22 is held against the sock roll 25 while an opposite edge 33 is pulled over the sock roll 25. This method for rolling up a pair of socks into a roundish object is known. However, the method of the present invention enables the sock roll 25 to be transformed into a three dimensional recognizable object. By placing a design on the upper inside surface 14 of sock 12, the rolled sock transforms into a roundish object decorated with the three dimensional graphic design 13.

The design 13 on the inside surface 14 of the second sock 12 comprises artwork that may include figures, shapes, patterns, text or other indicia as desired. The artwork, when placed on the sock, should be a three dimensional design graphic which, when rolled, becomes a three dimensional recognizable object. These graphic designs or patterns placed on the sock may be of any type suitable for creating a likeness of a three dimensional object. Designs that simulate the exterior of sports equipment such as basketballs, footballs, baseballs, soccer balls or tennis balls are particularly well suited for this invention. For the graphic design placement method, the graphic design 13 preferably should not be visible through the sock during its normal use.

A three dimensional graphic design is actually a two dimensional graphic layout of a three dimensional object which illustrates the surface areas of the three dimensional object being portrayed. This three dimensional graphic design can then be manipulated to take on a similar shape of a particular portrayed three dimensional object. The combination of transforming into a similar shape and graphically displaying similar surface areas as that of the portrayed three dimensional object creates a recognizable likeness and is the basis of the transformational ability of this invention.

Figure 8:
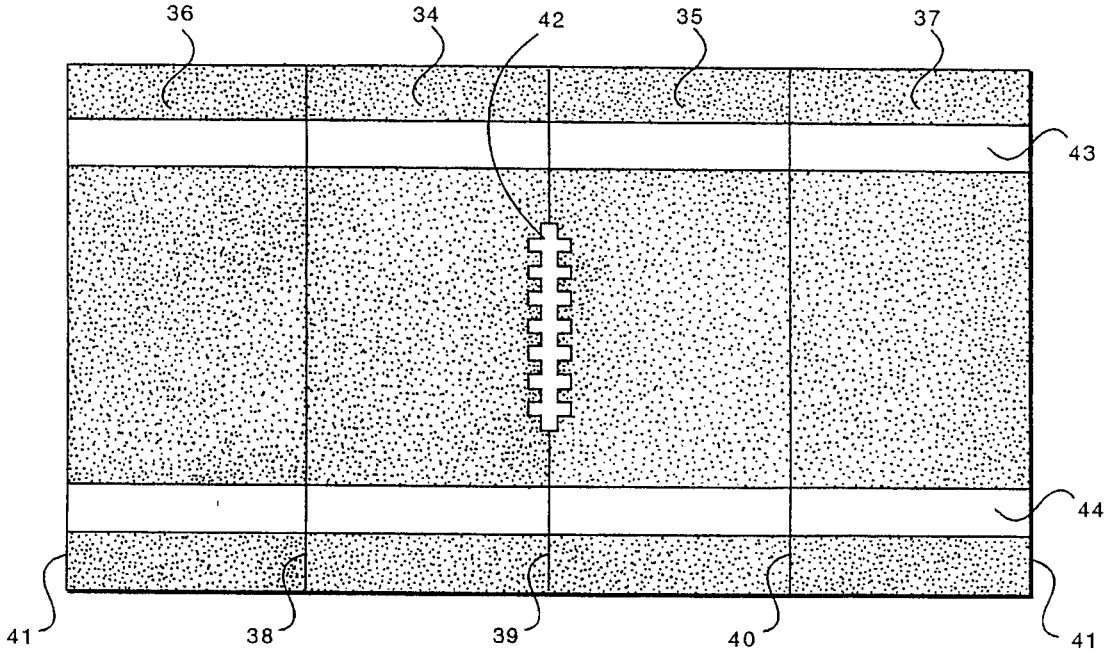
FIG. 8 is a plan view of a two dimensional graphic layout of the surface areas of a (football) three dimensional object, prior to changing into a three dimensional graphic design.

A good example of a recognizable three dimensional object is a football. As shown in FIG. 8, a three dimensional graphic design is being created by first mapping out the surface areas of a football by use of a two dimensional graphic layout. This layout illustrates that a football is generally made up of four panels or surface areas. A front left panel 34, a front right panel 35, a back left panel 36 and a back right panel 37. These panels or surface areas are separated by lines 38, 39, 40 and 41. As with all footballs, two of the panels are joined with the familiar stitch design 42. Stripes 43 and 44 are usually displayed near the ends of the panels of a football.

Figure 9:
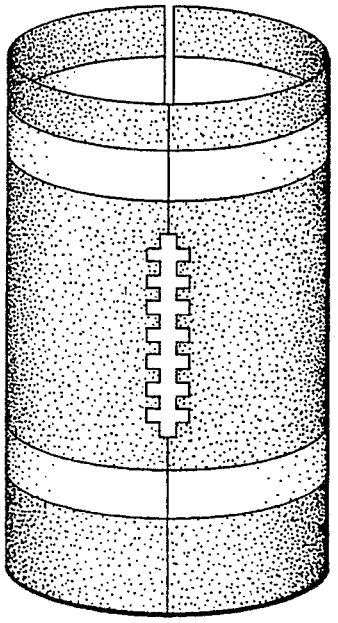
FIG. 9 shows the same surface areas as shown in FIG. 8 after being transformed into a tube shape.

FIG. 9 shows the same configuration of the similar surface areas of the football as shown in FIG. 8 after being transformed into a tube shape such as that of the inside surface of the upper portion of tube sock.

Figure 10:
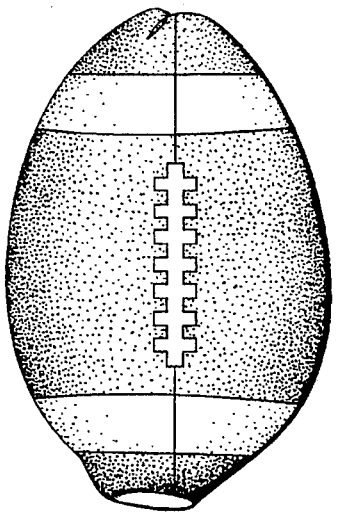
FIG. 10 shows a three dimensional graphic design because the two dimensional graphic layout transformed into a similar shape of, and graphically displays, similar surface areas of a football.

FIG. 10 shows how the three dimensional graphic design creates the likeness of a football by transforming into a similar shape of a football as well as graphically displaying similar surface areas as that of a football.

After the sock is rolled up in the manner described above, the graphic design 13 appears on the outside of the rolled up socks as shown in FIG. 6. The embodiment shown in this figure illustrates a football design.

Since socks are normally used and worn as pairs, the main thrust of the application has been in the direction of pairs of socks. However, it is equally obvious that the invention may be applicable to a single sock which may be graphically enhanced with the desired graphic design and then rolled into the final shape.

Various modifications may be made of the invention without departing from the scope thereof and it is desired, therefore, that only such limitations shall be placed thereon as are imposed by the prior art and which are set forth in the appended claims.

What is claimed is:

1. A method of transforming a pair of socks into a three dimensional recognizable object, each of the socks having a toe, an outside surface, an inside surface, an open top, an upper portion, and a lower portion, the upper portion and the lower portion defining a middle area therebetween, the pair of socks defining a first sock and a second sock, the method comprising the steps of:

placing a three dimensional graphic design matching an exterior of a baseball on the inside surface of the upper portion of the first sock to define a graphically designed portion of said sock;

placing the second sock upon the first sock, the socks being positioned such that the toes and the tops of the socks are generally aligned to form aligned socks;

tucking the toes of the aligned socks against the lower portion of the socks to form tucked, aligned socks;

rolling the pair of tucked, aligned socks from the lower portion to the upper portion of the socks to form a sock roll;

holding an edge of the top of the graphically designed portion of the first sock against the sock roll to form a held edge;

pulling an opposite edge of tile top of tile first sock in the opposite direction of the held edge; and stretching the opposite edge of the top of the first sock over the sock roll until it meets the held edge to form a three dimensional graphic design matching an exterior of a baseball.

2. A method of transforming a pair of socks into a three dimensional recognizable object, each of the socks having a toe, an outside surface, an inside surface, an open top, an upper portion, and a lower portion, the upper portion and the lower portion defining a middle area therebetween, the pair of socks defining a first sock and a second sock, the method comprising the steps of:

placing a three dimensional graphic design matching an exterior of a football on the inside surface of the upper portion of the first sock to define a graphically designed portion of said sock;

placing the second sock upon the first sock, the socks being positioned such that the toes and the tops of the socks are generally aligned to form aligned socks;

tucking the toes of the aligned socks against the lower portion of the socks to form tracked, aligned socks;

rolling the pair of tucked, aligned socks from the lower portion to the upper portion of the socks to form a sock roll;

holding an edge of the top of the graphically designed portion of the first sock against the sock roll to form a held edge;

pulling an opposite edge of the top of the first sock in the opposite direction of the held edge; and stretching the opposite edge of the top of the first sock over the sock roll until it meets the held edge to form a three dimensional graphic design matching an exterior of a football.

3. A method of transforming a pair of socks into a three dimensional recognizable object, each of the socks having a toe, an outside surface, an inside surface, an open top, an upper portion, and a lower portion, the upper portion and the lower portion defining a middle area therebetween, the pair of socks defining a first sock and a second sock, the method comprising the steps of:

placing a three dimensional graphic design matching an exterior of a tennis ball on the inside surface of the upper portion of the first sock to define a graphically designed portion of said sock;

placing the second sock upon the first sock, the socks being positioned such that the toes and the tops of tile socks are generally aligned to form aligned socks;

tucking the toes of the aligned socks against the lower portion of the socks to form tucked, aligned socks;

rolling the pair of tucked, aligned socks from the lower portion to the upper portion of the socks to form a sock roll;

holding an edge of the top of tile graphically designed portion of the first sock against the sock roll to form a held edge;

pulling an opposite edge of the top of tile first sock in the opposite direction of the held edge; and stretching the opposite edge of the top of the first sock over the sock roll until it meets the held edge to form a three dimensional graphic design matching an exterior of a tennis ball.

4. A method of transforming a pair of socks into a three dimensional recognizable object, each of the socks having a toe, an outside surface, an inside surface, an open top, an upper portion, and a lower portion, the upper portion and the lower portion defining a middle area therebetween, the pair of socks defining a first sock and a second sock, the method comprising the steps of:

placing a three dimensional graphic design matching an exterior of a soccer ball on the inside surface of the upper portion of the first sock to define a graphically designed portion of said sock;

placing the second sock upon the first sock, the socks being positioned such that the toes and the tops of the socks are generally aligned to form aligned socks;

tucking the toes of the aligned socks against the lower portion of the socks to form tucked, aligned socks;

rolling the pair of tucked, aligned socks from the lower portion to the upper portion of the socks to form a sock roll;

holding an edge of the top of the graphically designed portion of the first sock against the sock roll to form a held edge;

pulling an opposite edge of the top of the first sock in the opposite direction of the held edge; and stretching the opposite edge of the top of the first sock over the sock roll until it meets the held edge to form a three dimensional graphic design matching an exterior of a soccer ball.

5. A method of transforming a pair of socks into a three dimensional recognizable object, each of the socks having a toe, an outside surface, an inside surface, an open top, an upper portion, and a lower portion, the upper portion and the lower portion defining a middle area therebetween, the pair of socks defining a first sock and a second sock, the method comprising the steps of:

placing a three dimensional graphic design matching an exterior of a basketball on the inside surface of the upper portion of the first sock to define a graphically designed portion of said sock;

placing the second sock upon the first sock, the socks being positioned such that the toes and the tops of the socks are generally aligned to form aligned socks;

tucking the toes of rite aligned socks against the lower portion of the socks to form tucked, aligned socks;

rolling the pair of tucked, aligned socks from the lower portion to the upper portion of the socks to form a sock roll;

holding an edge of the top of the graphically designed portion of the first sock against the sock roll to form a held edge;

pulling an opposite edge of the top of the first sock in the opposite direction of the held edge; and stretching the opposite edge of the top of the first sock over the sock roll until it meets the held edge to form a three dimensional graphic design matching an exterior of a basketball.

* * * * *